US007103960B2

(12) United States Patent
Aimé

(10) Patent No.: US 7,103,960 B2
(45) Date of Patent: Sep. 12, 2006

(54) METHOD FOR PROVIDING A BACKING MEMBER FOR AN ACOUSTIC TRANSDUCER ARRAY

(75) Inventor: Flesch Aimé, Andrésy (FR)

(73) Assignee: Vermon, Tours Cedex (FR)

( * ) Notice: Subject to any disclaimer, the term of this patent is extended or adjusted under 35 U.S.C. 154(b) by 56 days.

(21) Appl. No.: 10/273,996

(22) Filed: Oct. 21, 2002

(65) Prior Publication Data

US 2003/0029010 A1 Feb. 13, 2003

Related U.S. Application Data

(62) Division of application No. 09/577,342, filed on May 24, 2000, now Pat. No. 6,467,138.

(51) Int. Cl.
*H04R 31/00* (2006.01)

(52) U.S. Cl. ..... 29/594; 29/592.1; 29/602.1; 29/609.1; 83/25; 83/42; 83/103; 181/171; 181/172; 205/119; 205/122; 310/326; 310/327; 381/396; 381/398; 451/5; 451/41

(58) Field of Classification Search ..... 29/592.1, 29/594, 602.1, 609.1; 181/171, 172; 83/25, 83/42, 103; 205/119, 122; 381/396, 398; 451/5, 41; 310/326, 327
See application file for complete search history.

(56) References Cited

U.S. PATENT DOCUMENTS 5,099,459 A 3/1992 Smith ..... 367/153
5,267,221 A 11/1993 Miller David G. et al. . 367/140
5,331,567 A 7/1994 Gibbons et al. ..... 703/1
5,648,942 A 7/1997 Kunkel, III ..... 367/176

FOREIGN PATENT DOCUMENTS

JP 08275295 A 10/1996

OTHER PUBLICATIONS

"A 2.5 MHz 2D array with Z-axis electrically conductive backing"; Greenstein, M.; Lum, P.; Yoshida, H.; Seyed-Bolorforosh, M.S.; Ultrasonics, Ferroelectrics and Frequency Control, IEEE Transactions on Sep. 5, 1997; pp. 970-977.

*Primary Examiner*—Paul D. Kim
(74) *Attorney, Agent, or Firm*—Stites & Harbison PLLC; Ross F. Hunt, Jr.

(57) ABSTRACT

A method is provided for making a backing layer for an ultrasonic matrix array transducer useful in medical imaging and the like. A conductive grid is provided which includes a plurality of micro-contacts each joined together by a common base so that spaces are provided between the free ends of the contacts. A mold for the grid is filled with an acoustically absorbent material such that the absorbent material fills the spaces between the contacts, so as to produce a block when cured. The common base is removed so as to separate the contacts from one another within the block. Further machining exposes the opposite ends of micro-contacts so that a like number of contact faces or pads are provided at opposed surfaces of the backing layer. Improved transducer constructions are also disclosed.

17 Claims, 4 Drawing Sheets

FIG. 1
PRIOR ART
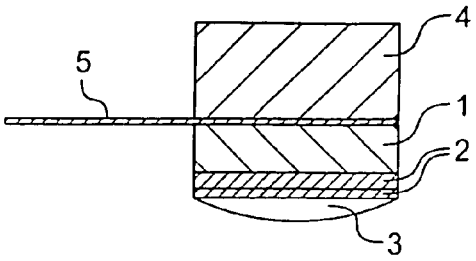
FIG. 2
PRIOR ART
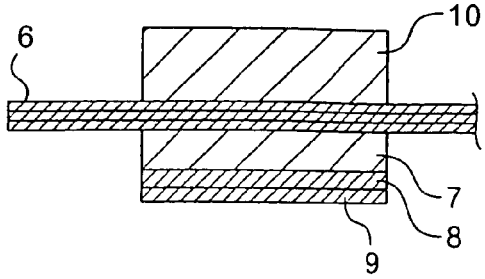
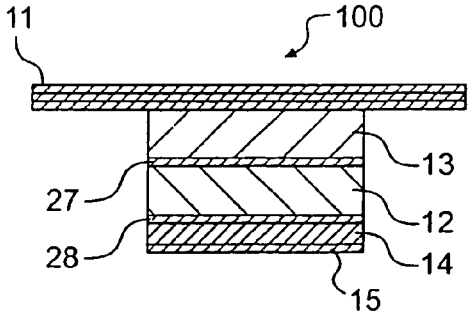
FIG. 3
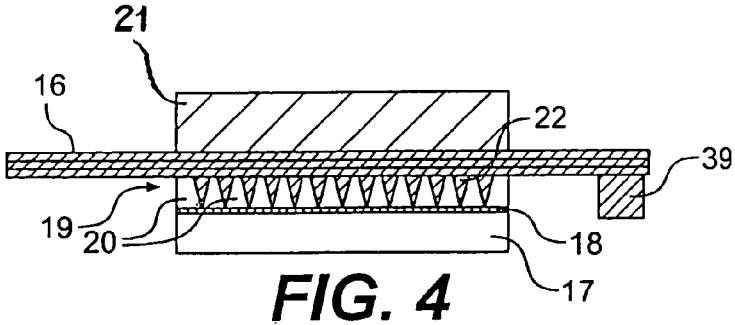
FIG. 4
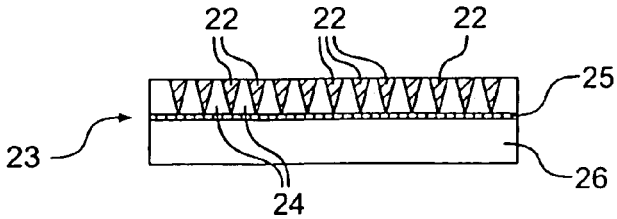
FIG. 5(a)

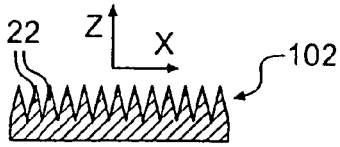
FIG. 6(a)
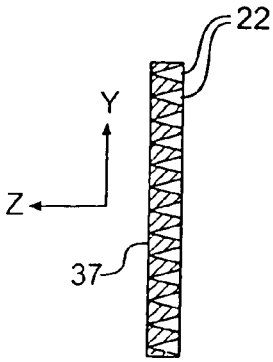
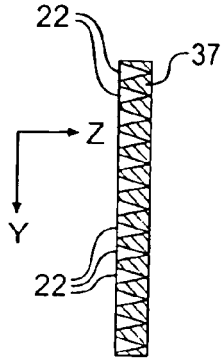
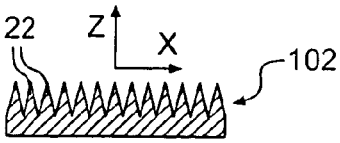
FIG. 6(b)
FIG. 6(f) FIG. 6(h)
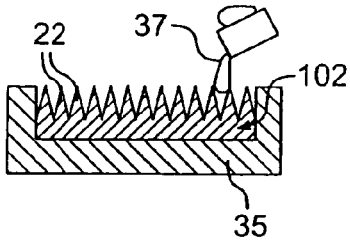
FIG. 6(c)
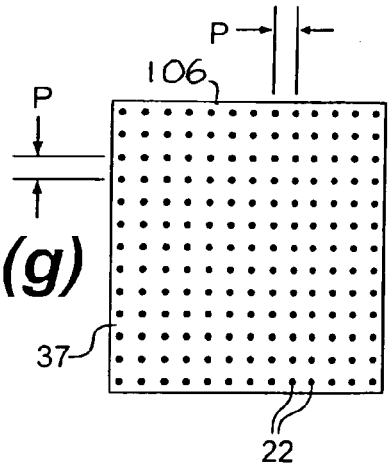
FIG. 6(g)
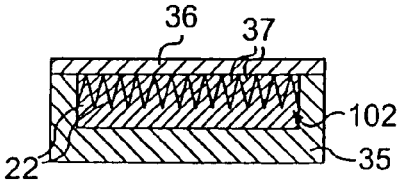
FIG. 6(d)
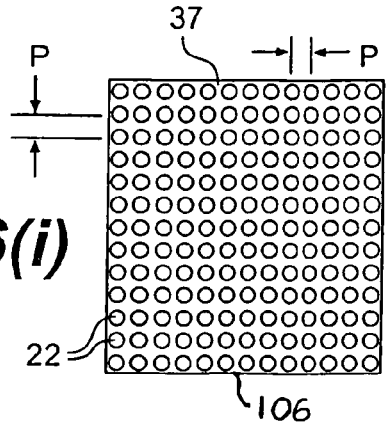
FIG. 6(i)

METHOD FOR PROVIDING A BACKING MEMBER FOR AN ACOUSTIC TRANSDUCER ARRAY

CROSS-REFERENCE TO RELATED APPLICATIONS

This application is a division of application Ser. No. 09/577,342, filed on May 24, 2000.

BACKGROUND OF THE INVENTION

1. Field of the Invention

The present invention relates to ultrasonic transducers such as used for diagnostic imaging, non-destructive material testing and treatment of human organs and to methods for making such transducers.

2. Background of the Invention

Many types of transducers have been developed for a variety of imaging applications. Ultrasonic devices such as single element, annular arrays, one-dimensional arrays, 1.5 dimensional linear arrays and two-dimensional (2D) matrix arrays are examples of devices used as medical transducers. Recently, matrix shaped ultrasonic transducers designed for three-dimensional (3D) imaging capabilities have been introduced into the marketplace. Reference is made, for example, to U.S. Pat. No. 5,732,706 (White et al) which discloses a piezoelectric matrix array transducer connected into an integrated circuit. For a matrix transducer, the active surface is generally square shaped and the elements are arranged in a N by N matrix fashion wherein each transducer is individually addressed so any focal depth can be electronically controlled. As disclosed in U.S. Pat. No. 5,894,646 (Hanafy et al), typical manufacturing and interconnection methods for matrix transducers are based on the extension of existing manufacturing processes developed for one dimensional linear array transducers. However, these manufacturing methods have led to compromises in performance and to complexity in fabrication. Typically, a single flexible circuit or printed circuit board is used to connect the individual elements of a transducer array to a transducer cable. The use of this technique for a matrix array is not practical because the number of elements involved is significantly higher. For example, there may be 64 to 256 elements in a standard transducer, whereas a matrix transducer has up to 10,000 elements and potentially even more. Standard flexible circuits do not have the density required for this number of elements and thicker multilayer printed circuit boards, such as disclosed in the U.S. Pat. No. 5,855,049 (Corbett et al) degrade the performance of the transducer when placed between the piezoelectric material and the backing material.

According to the requirements of ultrasonic imaging, array transducers must exhibit acceptable acoustic performance to enable the system to provide high quality images. In general, matrix transducers must yield a 2D ultrasonic image quality approaching that obtained with linear array transducers, which means that individual transducer elements of the matrix must be designed to operate substantially identically to conventional transducers.

Ultrasonic transducers are designed to operate in a forward direction, meaning that, in medical applications, the ultrasonic transducer is pointed toward the organ to be imaged. As a consequence, such transducers are constructed to enhance sound propagation from the front face thereof and to minimize sound propagation from the back side thereof. The acoustic energy or reflections emanating from the rear face of the transducer is minimized by the use of a backing material.

Referring to FIG. 1, there is shown, in a cross-section, a typical prior art construction of a linear ultrasonic transducer. The transducer comprises the following components: a focusing lens 3, one or more impedance matching layers or members 2, a piezoelectric layer or member 1, an interconnect layer or member 5 and a sound absorbing backing layer or member 4. Typically, interconnect layer 5 is made of, or formed by, a flexible circuit or printed circuit board. A typical matrix array is shown in cross-section in FIG. 2. The matrix array is similar to the standard transducer except for the absence of a focussing lens and a much thicker interconnection layer 6, and includes an impedance matching layer 8, a further matching layer 9, a piezoelectric layer 7 and a sound absorbing backing layer 10. As illustrated in FIGS. 1 and 2, the interconnect layer 5 or 6 is usually placed at the interface between backing layer 4 or 10 and the piezoelectric material 1 or 7.

Numerous techniques of 2D connection have been developed during recent years, but none of these has provided a satisfactory solution to the problems sought to be solved by the present invention. These prior art attempts sometimes include the use of so-called "visible" multi-layer circuits which dramatically degrade the transducer response from reflections and sometimes use a connecting method so complicated that the resulting transducer is simply too expensive and unreliable to manufacture.

A further patent of interest here is U.S. Pat. No. 5,267,221 (Miller). This patent discloses an acoustic transducer assembly having a one or two dimensional array of transducer elements, an electrical circuit element such as a printed circuit board and a backing block for interconnecting transducer elements to corresponding contacts or traces of the board. Individual contacts for each transducer element are provided on the top and bottom surfaces of the backing block. The backing block comprises acoustic attenuating material having conductors extending therethrough which interconnect each transducer element to a corresponding circuit contact. The conductors are implemented using thin conductors, conducting fibers or foils, and multiple thin conductors or conducting fibers or foils may be used for each transducer element. This method however requires complicated tooling and methods to align the individual conductors. Furthermore the conductors are so thin as to make it difficult to achieve a reliable contact, and the conductors can collapse if excessive force is exerted on the backing.

There exists a need for a new way of interconnecting individual matrix transducer elements so as to provide a high density of interconnects without compromising the acoustic performance of the transducers.

SUMMARY OF THE INVENTION

In accordance with a first aspect of the invention, an improved method is provided for making matrix array transducers (as well as other transducers, as described below). This aspect of the invention is particularly concerned with making the backing block or layer of each transducer, i.e., the sound absorbing portion thereof. A second aspect of the invention concerns improved backing layers, and improved transducers including such backing layers, which incorporate constructional features resulting from the methods of the invention and improved transducers.

According to the first aspect of the invention, a method is provided for making a backing layer for a transducer array, the method comprising: providing a conductive grid comprising a plurality of contacts each having a free end and each being joined together by a common base at an end thereof opposite to the free end so that spaces are provided between the free ends of the contacts; placing the grid in a mold; filling the mold with an acoustically absorbent material such that the absorbent material fills the spaces of the grid; curing the material in the mold so as to form a block comprising the cured absorbent material and the grid; releasing the block from the mold; and removing, e.g., by machining, the common base of the grid in the block so as to separate the contacts from one another within the block.

In one preferred embodiment, the grid is provided by cutting into one surface of a plate of conductive material to form the free ends of the contacts while retaining the common base. Advantageously, the contacts are pyramidal in shape and the cutting step comprises using perpendicular passes of a dicing saw to form said pyramidal contacts. The dicing blade can either have an angular cross-section corresponding to the angle of the pyramidal contacts or alternatively the block can be inclined to create the pyramidal shape.

In an alternative preferred embodiment, the grid is formed by an electro-forming or electro-deposition process. Advantageously, the grid is formed using a master mold having a shape matching that of the grid, electro-depositing metal on the grid, and removing the master mold to form the grid. The master mold preferably includes a plurality of protrusions therein of a shape, and arranged in a pattern, matching that of the contacts so that when said master is removed, hollow contacts are formed.

In one implementation of this embodiment, the hollow contacts are filled with acoustically absorbent material, while, in another, the hollow contacts are filed with metal.

Preferably, after the backing material is molded, the common base is removed by machining away the base. Additionally, the method preferably further comprises machining the block at a surface thereof opposite to the base to expose the free ends of the contacts. The result of the machining is a backing layer and, in an advantageous embodiment, a plurality of machined backing layers are stacked to form a stacked backing layer.

In one preferred implementation, a backing layer is produced which is substantially larger in an area than a transducer to which the backing layer is to be applied and the backing layer is subsequently cut so that the area thereof matches that of the transducer.

In accordance with a further embodiment of the first aspect of the invention, a method is provided for making a backing layer for a transducer array, the method comprising: cutting a plate of conductive material to form a plurality of pyramids joined together at a common base and defining spaces therebetween; placing the plate into a mold; filling the mold with an acoustically absorbent material such that the absorbent material fills the spaces between the pyramids; curing the acoustically absorbent material to form a block comprising the absorbent material and the plate; and machining opposite surfaces of the block such that the plurality of pyramids are separated from one another by machining away the common base to form a plurality of contacts at one surface and such that the tops of the pyramids are exposed so as to form a like plurality of contacts at the opposite surface. The cutting step advantageously comprises forming perpendicular V grooves using perpendicular passes of a dicing saw in order to form the pyramids.

In accordance with one embodiment of the second aspect of the invention, a transducer array is provided which comprises: a transducer layer comprising a plurality of piezoelectric elements; an interconnect layer having a plurality of contacts; and a backing layer disposed between the transducer layer and the interconnect layer, the backing layer including a plurality of conductive micro-contacts extending therethrough from a first surface of the backing layer in contact with the transducer layer to a second surface of the backing layer in contact with the interconnect layer such that the plurality of conductive micro-contacts are aligned with the plurality of piezoelectric elements and with the plurality of contacts of the interconnect layer, the plurality of conductive micro-contacts being of a smaller cross-sectional area at the first surface of the backing layer than at the second surface of the backing layer.

In an advantageous implementation, a plurality of the backing layers are stacked between the transducer layer and the interconnect layer.

In one preferred embodiment, the micro-contacts are pyramidal in shape, while, in another, the micro-contacts are conical in shape.

According to a further embodiment of the second aspect of the invention, a backing layer for an ultrasonic transducer array is provided, the backing layer comprising: a layer of acoustically absorbent non-conductive material having first and second opposing surfaces; and a plurality of conductive contacts extending through the layer from the first surface to the second surface so that a first end of the contacts is exposed at the first surface and a second, opposite end of the contacts is exposed at the second surface; the exposed first end of each of the contacts having a cross-sectional area smaller than that of the second exposed end of the contacts. As above, in one advantageous implementation, the micro-contacts are conical in shape, while, in another, the micro-contacts are pyramidal in shape.

Further features and advantages of the present invention will be set forth in, or apparent from, the detailed description of preferred embodiments thereof which follows.

BRIEF DESCRIPTION OF THE DRAWINGS

FIG. 1, which was described above, is a schematic cross-section of a prior art linear array transducer including an interconnect layer for making contact with elements of the array;

FIG. 2, which was also described above, is a schematic cross-section, similar to FIG. 1, of a prior art matrix array transducer;

FIG. 3 is a schematic cross-sectional view of a matrix array transducer constructed in accordance with a first preferred embodiment of the invention;

FIG. 4 is a schematic cross-sectional view showing details of the integrated connector backing sheet of FIG. 3;

FIGS. 5(*b*) and 5(*c*) are top and bottom perspective views of the contact grid of FIG. 5(*a*);

FIG. 5(*d*) is a top perspective view of a further implementation of the contact grid of FIG. 5(*a*);

FIGS. 6(*j*) and 6(*k*) are top plan views of a backing layer and matrix array, respectively, illustrating an alignment technique for aligning the two; and FIG. 6(*l*) is a cross-sectional view of a further preferred embodiment of the matrix array transducer of the invention, employing multiple backing layers.

DESCRIPTION OF THE PREFERRED EMBODIMENTS

Figure 6E:
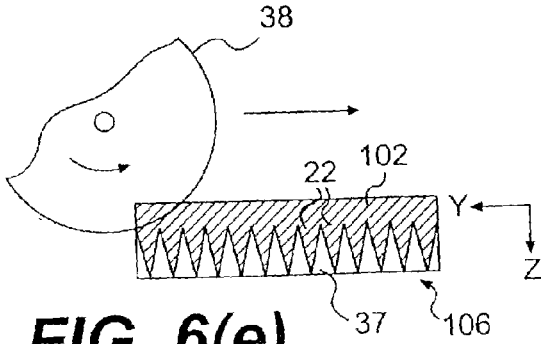
FIGS. 6(*a*) to 6(*i*) are cross-sectional views of steps in a manufacturing and assembly process in accordance with a further preferred embodiment of the invention.
Figure 6L:
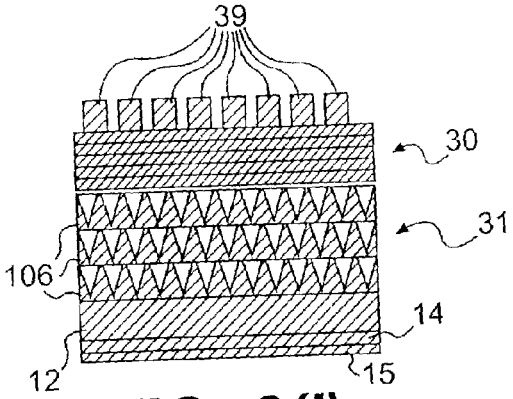

Considering the components of the matrix array transducer of the invention beginning with the piezoelectric elements, and referring to FIG. 3, a matrix array 100 is shown which includes a piezoelectric member 12 sandwiched between a ground electrode 28 and a negative polarization electrode 27. Piezoelectric member 12 is ground on both faces to have a constant thickness that is given by the following equation: t=v/(2 * Fa), where t is the thickness, v is the velocity of sound in the material, and Fa is the anti-resonance frequency. The surfaces of member 12 are then electro-plated with copper or gold. For negative impulse excitation systems, the positive polarization orientation is marked as the ground electrode 28 of the transducer array 100. A dicing operation is performed on the rear, negative polarization electrode 27. This operation involves separating the rear electrode 27 into a plurality of individual elements that correspond to the elements of the transducer. It is important to notice that for a piezoelectric composite transducer, only the rear electrode 27 has to be diced, while when using ceramic or monolithic crystal material, a partial or complete cutting is required to isolate the elements from each other. The front electrode 28 remains intact and, as indicated above, acts as a ground electrode for the entire array 100. This front electrode 28 is normally connected to the ground of the cable. The front electrode 28 also provides EMI protection for signals from the transducer.

The front face of transducer 100 is preferably matched to the adjacent medium by using one, two or several impedance matching layers. Two such layers 14 and 15 are shown in FIG. 3. Usually, the first matching layer 14 and the second matching layer 15 are made of polymer or resin. It should be noted that in some applications only one matching layer need be used. In cases where multiple matching layers are used, the first layer 14 is preferably filled with mineral or metallic particles in order to exhibit a higher acoustic impedance than the second layer 15. The determination of matching layer acoustic impedance is carried out in a conventional manner, and the thickness of each layer is preferably adjusted to ¼ of a wavelength in order to improve the bandwidth of transducer without any significant effect on sensitivity.

Normally, matrix arrays used for ultrasonic imaging do not need a geometrical focusing lens, because the array is driven by electronic apertures in all directions and an acoustic lens is of no use.

FIG. 3 also shows a backing block 13. Considering first the backing material from which block 13 is made, block 13 is preferably made of flexible resins or polymers (Emerson & Cuming 1245) filled with mineral or metallic particles, typically wolfram powder. Other materials for block 13 and methods of making the block itself are known to those skilled in the art and could be used for the present invention as well. The backing material typically has an acoustic impedance in the range of 2 to 10 Mrayls depending on the percentage of mineral or metallic fillers. The attenuation coefficient of such backing material is usually >7 dB/mm/MHz so this gives a round trip attenuation value of around 70 dB for a 0.5 mm thick backing operating at 10 MHz. The backing block 13 also has conductive micro-contacts running therethrough as discussed below.

It can be seen in FIG. 2 that in order to increase the number of contacts, the interconnect layer (denoted 6 in FIG. 2 and 11 in FIG. 3) must be made thicker. This increase in thickness increases the reflection of sound waves as opposed to absorbing the waves. In a first embodiment of the invention a series of interconnect electrodes or contacts are incorporated within the backing material itself. These contacts, which are described below beginning with FIG. 4, permit the interconnection to take place behind the backing block 13 and out of the path of the acoustic energy.

Referring to FIG. 4, the details of a backing sheet or layer constructed in accordance with a preferred embodiment of the invention are shown. The overall transducer construction shown in FIG. 4 includes a transducer member 17, transducer rear electrodes 18, the backing layer 19, an interconnect layer 16 and a carrier member or layer 21 affixed to interconnect layer 16 and in alignment with backing layer 19.

Within the backing material 20 of backing layer 19 is embedded a grid of micro-contacts or contact members 22 which traverses the thickness of the material to provide continuity from the front to the back face. The micro-contacts or contact members 22 are preferably provided in conical or pyramidal forms because these forms provide important advantages as discussed below, but the contact members 22 could also be cylindrical or parallelepiped in shape. As illustrated, the backing face of layer 19 is assembled against the transducer rear electrodes 18, and the interconnect layer 16 is mounted on the opposite face of the backing material of layer 19.

The micro-contacts 22 of the grid of micro-contacts are preferably made of an electrically conductive metal, or an electrically conductive material e.g, a non-metallic conductive material. The interconnection of the rear face of backing sheet 19 to the associated matrix cables (not shown) is performed by the interconnect layer 16 which can be implemented using either a printed circuit board or flexible circuits. The interconnect layer 16 is generally terminated with multi-pin connectors 39 compatible with those of the coaxial cables typically used for transducers.

Figure 5B:
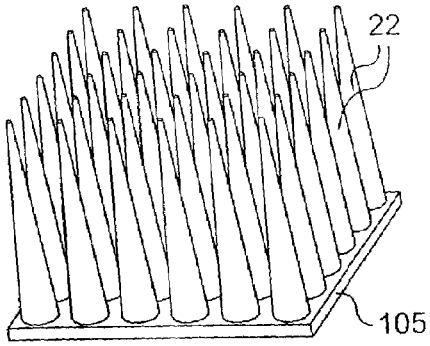
FIG. 5(*a*) is a schematic cross-sectional view of a further preferred embodiment of the invention.
Figure 5D:
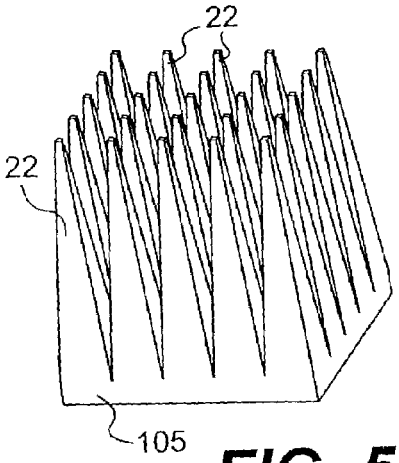
Figure 5C:
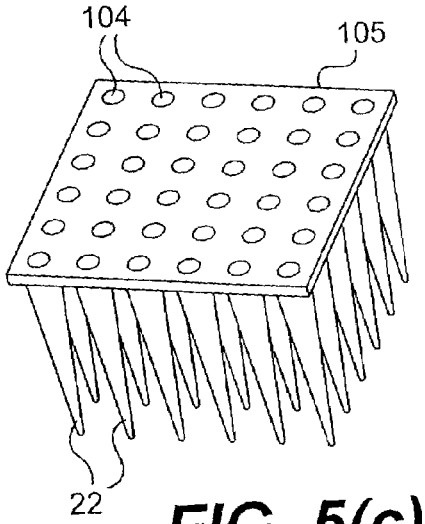
Figure 6J:
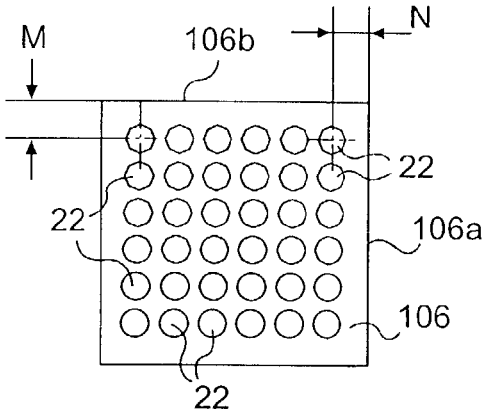
Figure 6K:
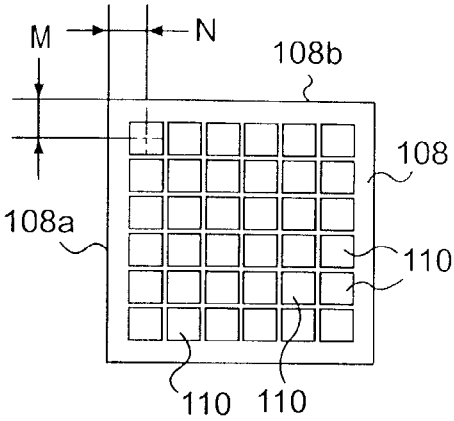

The embodiment of FIG. 5(*a*) is similar to that of FIG. 4, but, as discussed in more detail below, the backing layer 23 includes hollow conical or pyramidal contact members 22 embedded within backing material 24. A transducer rear electrode layer is indicated at 25 and the piezoelectric member or layer at 26.

In the operation of the embodiment illustrated in FIG. 4, backward acoustic energy is directed perpendicularly from the rear surface of each transducer element to the backing layer 19. The acoustic waves meet the grid of micro-contacts 22 and rather than being reflected directly back to the transducer 17, are back-scattered by the surface of micro-contacts 22 because of the angular surfaces provided by the conical or pyramidal shapes thereof. This action will spread the acoustic energy in all directions so the power thereof is attenuated. The acoustic energy that has traversed the backing sheet 19 is partially directed through the back material filled spaces 20 between the micro-contacts 22 and then is lost into the next thickness of the backing sheet which is stacked, as needed, to provide the appropriate attenuation properties. (An embodiment wherein a plurality of backing sheets 106 are stacked on top of each other is shown in FIG. 6(*l*) and described below.) Finally, the residual returned acoustic energy is removed by the simple action of attenuation in the backing material itself. The returned acoustic energy that is received by the transducer should not exceed −70 dB of the transmitted acoustic energy. Modifying the shape of the micro-contacts 22 or the backing attenuation coefficient may change this theoretical value.

It is also noted that micro-contacts 22, constructed as set forth above, will exhibit a thermal mass much higher than conventional tracks or traces on flexible circuits or printed circuit boards and that this mass can be used as a heat sink for thermal transfer from the rear side of the piezoelectric elements. In effect, each element of the array can have its own heat sink device. This property may be applied to high intensity focused ultrasound (HIFU) transducers, with the advantage of avoiding the use of a separate temperature regulation system.

The grid of micro-contacts 22 can be obtained by various manufacturing techniques. The simplest method of manufacturing the grid of micro-contacts 22 is to utilize a diamond blade dicing saw, of a thickness of roughly 10 μm, similar to those used in microelectronics for wafer dicing. In this method, which is illustrated in FIGS. 6(*a*) to 6(*e*), a metallic plate, ground with a flat top and bottom surface and a thickness of <1 mm, is positioned on the dicing machine (not shown). A V-shaped edged diamond blade can be used for dicing, and the small pyramid-like patterns can be obtained by providing two perpendicular dicing cuts. The dicing cuts produce a metallic plate or grid 102 as depicted in FIGS. 6(*a*) and 6(*b*). Because of the two perpendicular or orthogonal dicing cuts, the plate 102 looks the same from adjacent orthogonal sides, as is indicated in FIGS. 6(*a*) and 6(*b*). This manufacturing technique provides solid flat sided micro-contacts 22. The micro-contacts 22 are held together, and in place, due to the fact that the dicing cut does not extend entirely through the metal plate 102, as shown in FIGS. 6(*a*) and 6(*b*).

The grid of micro-contacts 22 can also be manufactured by alternative methods such as an electro-forming or electro-deposition process. In this process, a master pattern is fabricated which has exactly the same form as the desired object. The master is then immersed into a bath and connected to an electrode. A current flow is provided between the two different potentials and metal is deposited on the master. The master is then chemically removed from the contacts. With this process, a variety of forms and shapes can be achieved, and secondary plating processes, such as gold plating, can be added to decrease the contact resistance. FIGS. 5(*a*), 5(*b*) and 5(*c*) show an example of this process. As indicated above, in FIG. 5(*a*), the backing layer is denoted 23, a transducer element or member is indicated at 26 and the rear transducer electrodes at 25. The micro-contacts 22 of the backing layer have uniform thickness, are of a hollow shape and can be filled with backing material 24 through holes 104 in a grid base plate 105 shown in FIG. 5(*c*) and formed by the open ends of the hollow micro-contacts 22. If high thermal conductivity is required, the hollow space within micro-contacts 22, which is accessed by holes 104, can be filled with high thermal conductive material to serve as a heat-sink. A pyramidal embodiment is shown in FIG. 5(*d*).

Returning again to the method of FIGS. 6(*a*) to 6(*e*), FIG. 6(*c*) shows a grid 102 of micro-contacts 22 disposed on the base thereof in a mold 35, with the contacts 22 pointing upwards. The backing material, denoted 37, is poured over the contacts as is indicated schematically in FIG. 6(*c*), and the mold 35 is then sealed with a rigid plate 36, as shown in FIG. 6(*d*). The resultant backing sheet, which is denoted 106, is then turned upside down and cured. In this way, filled particles in backing mixture will deposit on the side facing the piezoelectric element to provide an impedance gradient beginning at the surface of the piezoelectric element which can also improve the transducer bandwidth.

Before the backing sheet 106 is machined, sheet 106 is of the construction of FIG. 6(*d*). Once the curing of backing sheet 106 is complete, the backing sheet 106 is ground or machined in order to provide a flat surface and to ensure the contacts 22 are exposed on the surface. Next, as shown in FIG. 6(*e*) a grinding wheel 38 grinds off the excess metal from grid 102. After the grinding or machining is completed, the backing sheet looks like it does in FIGS. 6(*f*) and 6(*g*) and FIGS. 6(*h*) and 6(*i*) in which the pitch of the resulting matrix is indicated at p. The grinding is complete when the micro-contacts are spaced at a distance which is at least greater than one wavelength. In other words, the thickness of the backing sheet depends on the pitch of the matrix (i.e., the spacing between adjacent contacts 22 at the matrix surface), the transducer frequency and the angle of the contacts 22. The pitch of the matrix is more formally defined as the distance between the centers of two adjacent micro-contacts or contact members 22. As shown in FIGS. 6(*g*) and 6(*i*), the contact members 22 form contact pads at the surfaces of the backing sheet 106 formed by backing material 37. The contact pads are connected together by through conductors formed by the intermediate body portions of contact members 22 as shown in FIGS. 6(*f*) and 6(*h*).

It will be appreciated that the backing sheet 106 must be aligned with the piezoelectric elements of transducer member. One way to align the two is that illustrated in FIGS. 6(*j*) and 6(*k*), i.e., to make the backing sheet 106 with two precise reference edges 106*a* and 106*b* for referencing the pattern of contacts 22 in the backing sheet 106 to the piezoelectric elements 110 of a matrix array 108. These surfaces are referenced either with the mold 35 of FIG. 6(*c*), or by secondary machining. The corner contacts 22 and elements 110 are spaced precise distances M and N from these edges and thus, when the outside edges 106*a* and 106*b* of backing sheet 106 are aligned with the outside edges 108*a* and 108*b* of the matrix array 108, the micro-contacts 22 of the backing sheet 106 are respectively aligned with individual piezoelectric elements 110.

A further method of referencing or aligning the grid of micro-contacts 22 with the piezoelectric elements 110 is to use precisely located tooling holes (not shown) which are provided in both the backing sheet 106 and matrix array 108 and from which the contacts 22 and elements 110 can both be referenced.

Although this is not illustrated, it is noted that the backing sheet 106 can be made larger than the surface of the transducer member 108 to facilitate manufacturing, and then be subsequently diced into smaller portions to match the size of the specific transducer being made.

Turning again to FIGS. 3 and 4, and referring in this case to FIG. 4, to complete the connection from the rear of the backing block 19 to the cables (not shown), a multi-layer printed circuit board can be utilized as the interconnect layer 16. The pitch of contact or solder pads on the surface of the printed circuit board 16 is made to match the pitch of those on the backing block 19. Again, using two precise edges of the backing block 19 and two corresponding precise edges of the printed circuit board 16, the printed circuit board 16 can be placed onto the backing block 19 to ensure contact with the matrix of micro-contacts 22 on the backing surface. Alternatively, other methods of referencing the printed circuit board 16 to the backing sheet 19 (e.g., using fixtures or tooling holes) can also be employed.

The interconnect layer 16 is equipped with connectors (not shown) for plugging in the cables or for accepting multiplexing electronic devices to provide communication with the end user. In an alternative embodiment, a flexible circuit rather than a printed circuit board is used for the interconnect layer 16, and the flexible circuit is bonded or soldered to the rear face of the backing block 19.

Referring to FIG. 6(*l*), there is shown a preferred method of assembling the matrix transducer according to the present invention. In particular, as indicated above, FIG. 6(*l*) shows the basic concept of layering a backing sheet according to the invention, wherein multiple backing sheets 106 are stacked together to form the backing sheet layer 31. A suitable printed circuit board is indicated at 30.

Considering the connection of the piezoelectric elements to the backing sheet and referring, for example, to FIGS. 6(*j*) and 6(*k*), the piezoelectric elements 110 of the transducer matrix array must also be connected to the contacts 22 of the backing sheet 106. To do this, the backing sheet 106 and piezoelectric elements 110 are cleaned and an epoxy adhesive is applied to the mating surfaces. As described above, the two precise edges 106*a* and 106*b* of the backing sheet 106 are matched with the reference edges 108*a* and 108*b* of matrix array 108 to ensure proper mating of the contacts 22 to the piezoelectric elements 110. The assembly is cured under moderate pressure of approximately 5N/cm$^2$ to maintain electrical contact.

Considering the final assembly stage, and referring to FIG. 4 as exemplary, the final stage of the transducer assembly is to connect the printed circuit board or flexible circuit 16 to the backing sheet 19. This is preferably done by a bonding step as described above for bonding the backing sheet 19 to piezoelectric interface, but other methods can also be used such as directly soldering or connecting the individual wires to the back side of the printed circuit board 16.

For purposes of simplicity, the description above has exclusively dealt with a regular-pitch grid of micro-contacts 22 embedded in its corresponding backing sheet. However, this description is obviously not intended to limit the invention to this embodiment. Further, the foregoing techniques have been described in connection with matrix array transducers wherein the number of elements to be connected is much higher than conventional linear array transducers, and there is no doubt that the present invention is particularly advantageous in such an application. However, a backing sheet as described above is suitable for use with many different types of transducers. However, some further, different specific applications wherein the present invention can be advantageously used will now be described.

In connection with a standard linear array transducer, the use of the backing sheet of the invention will simplify the fabrication of such linear array transducers and will improve the performance and homogeneity. In use, the backing sheet plate is cut into strips having a width corresponding to the elevational dimension of the array. The size and pitch of the contacts can be tailored for many different applications.

Annular array transducers could also benefit from the backing sheet technology described above to improve repeatability in fabrication and performance as in linear arrays. In such an application, the grid of micro-contacts can have a regular pitch in one direction while, in the other direction, the pitch can be periodic with the periodicity corresponding to the external diameter of the array.

Figure 7A:
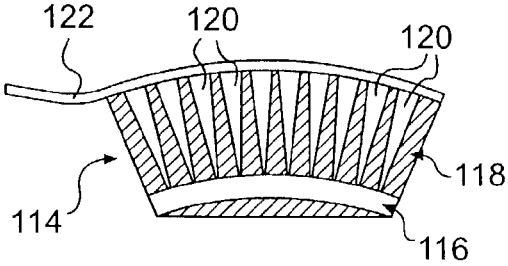
FIGS. 7(*a*) and 7(*b*) are cross-sectional views showing an alternative construction and application of the backing sheet of the invention.
Figure 7B:
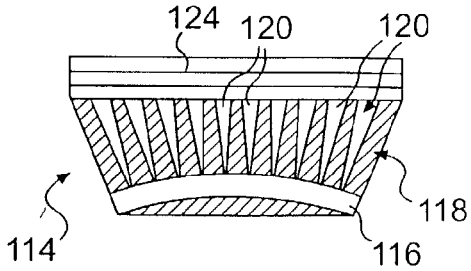

Moreover, with respect to array transducers of complex shape, the backing sheet assemblies and method described above are easily adapted to convex or other shaped transducers. The backing sheet plate can be constructed with the grid of micro-contacts having a concave profile on the face facing the transducer, or can be formed after the backing is cured. This is shown in FIGS. 7(*a*) and 7(*b*) which depict two different implementations of one example of this approach for a hard focused matrix array transducer 114. In FIG. 7(*a*), the transducer assembly 114 includes a piezoelectric member 116, a backing sheet 118 including micro-contacts 120 and a flexible circuit 122. FIG. 7(*b*) is similar and like elements have been given the same reference numerals, but differs in that a rigid printed circuit board 124 replaces flexible circuit 122. This method of the invention can also be adapted for this purpose by constructing the backing sheet with a convex face for typical curved linear array transducers.

The backing sheet assemblies and methods described above can also apply to stack array transducers. This family of transducers covers all transducers using multiple piezoelectric layers in forming a transducer having enhanced capacitance characteristics. Stack transducers are an interesting alternative to matrix systems, but manufacturing a piezoelectric stack matrix requires the use of thick film fabrication methods combined with LIGA techniques. The piezoelectric material is deposited in successive layers each having a thickness less than 100 μm. As the number of layers in the stack is increased, the overall capacitance is enhanced. Each transducer element of the matrix is built by the superposition of several layers of piezoelectric material connected in parallel (in a head to tail configuration). Thus, to produce a matrix array using this technique, each transducer element must have its own connection between the layers, as well as terminations on each surface of the piezoelectric block (terminations on the front surface are connected together to the ground). Because of the construction of the piezoelectric elements, the stack is quite sensitive with respect to temperature (depolarization), and, therefore, any heating (soldering) of the surface of element is precluded. Consequently, the use of backing sheet technology described above is particularly useful in avoiding damage to the materials used in stack array transducers.

The backing sheet technology described hereinbefore can also be used in connection with capacitive array transducers. Capacitive or electrostatic transducers are transducers wherein the capacitance is formed by the space existing between two silicon membranes. The array of transducers is easily mass fabricated by well known micro-machining processes commonly used in integrated circuits. Matrix transducers can be constructed from an array of micro-surface capacitive transducers, with the surface of each matrix element being defined by a set of capacitive transducers connected in parallel. Usually, capacitive transducers are very small in area (<100 μm). In general, the smaller the transducer area, the easier the fabrication, so each matrix transducer surface is formed by an array of capacitive transducers connected in parallel. Because of the method of fabrication used, the transducer produced is fragile, and thus, the use of the above-described backing sheet assembly as a connector carrier will improve reliability of the apparatus.

High frequency focused ultrasound transducers will also benefit from the backing sheet technology described above, especially when a solid grid of micro-contacts is used as a backing for the transducer. Heating from the transducer is efficiently directed to the backside of the backing sheet by interconnecting solid metal micro-contacts corresponding to those described above. The heat transfer coefficient of solid micro-contacts is at least 10 to 100 times those of copper traces of the flexible circuits 122 of FIG. 7(*a*) or the printed circuit board 124.

Although the invention has been described above in relation to preferred embodiments thereof, it will be understood by those skilled in the art that variations and modifications can be effected in these preferred embodiments without departing from the scope and spirit of the invention.

What is claimed is:

1. A method for providing a backing member for an acoustic transducer array, said method comprising the steps of:

providing a contact block member comprising an acoustically absorbent material having a plurality of individual conductive contact members of a pyramidal shape embedded therein such that said contact block member includes, at a first surface thereof, a plurality of contact pads of a first pattern formed by one end of said contact members, and includes, at a second, opposite surface thereof, a plurality of contact pads also of said first pattern formed by the opposite ends of said contact members, said contact pads of said first and second surfaces being connected together by conductive through conductors formed by said contact members, and said contact members being spaced apart from one another with a spacing corresponding to the pitch of the transducer array;

affixing an interconnection printed circuit board to one of said first and second surfaces so as to enable electrical signal to be supplied to the transducer array through the contact members; and affixing a carrier layer to said interconnection printed circuit board in alignment with said contact block member.

2. A method according to claim 1 wherein the step of providing a contact block member includes forming a grid of said contact members having a common base by cutting into one surface of a plate of bulk material to form said free ends of the contact members while retaining said common base, and depositing a conductive layer on said free ends using an electro-deposition process.

3. A method according to claim 2 wherein said cutting comprises using perpendicular cutting passes to form said pyramidal contact members.

4. A method according to claim 3 wherein said cutting passes are made using a dicing saw.

5. A method according to claim 1 wherein a grid of said contact members is formed using a non-metallic, conductive material.

6. A method according to claim 1 wherein a grid of said contact members is formed by an electro-deposition process.

7. A method according to claim 1 wherein the step of providing a contact block member includes forming a block including a grid of said contact members having a common base, removing said common base by machining away the base and machining said block at a surface thereof opposite to said base to expose the free ends of said contact members so as to thus form said contact pads.

8. A method according to claim 1 wherein the method produces a backing layer substantially larger in an area than a transducer to which the backing layer is to be applied and wherein said backing layer is subsequently cut so that the area thereof matches that of the transducer.

9. A method for providing a backing member for an acoustic transducer array, said method comprising:

providing a contact block member comprising an acoustically absorbent material having a plurality of individual conductive contact members of a pyramidal shape embedded therein such that said contact block member includes, at a first surface thereof, a plurality of contact pads of a first pattern formed by one end of said contact members, and includes, at a second, opposite surface thereof, a plurality of contact pads also of said first pattern formed by the opposite ends of said contact members, said contact pads of said first and second surfaces being connected together by conductive through conductors formed by said contact members, and said contact members being spaced apart from one another with a spacing corresponding to the pitch of the transducer array and each of said contact members being spaced from the other contact members without any direct contact with the other contact members.

10. A method according to claim 9 wherein said providing of said contact block member includes forming a grid of said contact members having a common base by cutting into one surface of a plate of bulk material to form said free ends of the contact members while retaining said common base, and depositing a conductive layer on said free ends using an electro-deposition process.

11. A method according to claim 10 wherein said cutting comprises using perpendicular cutting passes to form said pyramidal contact members.

12. A method according to claim 11 wherein said cutting passes are made using a dicing saw.

13. A method according to claim 9 wherein a grid of said contact members is formed using a non-metallic, conductive material.

14. A method according to claim 9 wherein a grid of said contact members is formed by an electro-deposition process.

15. A method according to claim 9 wherein said providing of said contact block member includes forming a block including a grid of said contact members having a common base, removing said common base by machining away the base and machining said block at a surface thereof opposite to said base to expose the free ends of said contact members so as to thus form said contact pads.

16. A method according to claim 9 wherein the method produces a backing layer substantially larger in an area than a transducer to which the backing layer is to be applied and wherein said backing layer is subsequently cut so that the area thereof matches that of the transducer.

17. A method for providing a backing member for an acoustic transducer array, said method comprising the steps of:

providing a contact block member comprising an acoustically absorbent material having a plurality of individual conductive contacts embedded therein such that said contact block member includes, at a first surface thereof, a plurality of pads of a first pattern formed by one end of said contacts, and includes, at a second, opposite surface thereof, a plurality of conductive pads also of said first pattern formed by the opposite ends of said contacts, said pads of said first and second surfaces being connected together by conductive through conductors formed by said contacts, and said contacts being spaced apart from one another with a spacing corresponding to the pitch of the transducer array;

affixing an interconnection printed circuit board to one of said first and second surfaces so as to enable electrical signal to be supplied to the transducer array; and affixing a carrier layer to said interconnection printed circuit board in alignment with said contact block member so as to increase the stiffness of the backing member a grid of said contact members being formed by an electro-deposition process.

* * * * *